US006325043B1

(12) United States Patent
Meistrick et al.

(10) Patent No.: US 6,325,043 B1
(45) Date of Patent: Dec. 4, 2001

(54) EXHAUST GAS RECIRCULATION DEVICE

(75) Inventors: Zdenek Meistrick, Bloomfield, CT (US); Yoshihide Maeda, Hino (JP); Vincent Pitzi, South Windsor, CT (US)

(73) Assignees: Hino Jidosha Kabushiki Kaisha, Tokyo (JP); Diesel Engine Retarders, Inc., Christiana, DE (US)

( * ) Notice: Subject to any disclaimer, the term of this patent is extended or adjusted under 35 U.S.C. 154(b) by 0 days.

(21) Appl. No.: 09/355,359

(22) PCT Filed: Jan. 9, 1998

(86) PCT No.: PCT/JP98/00051

§ 371 Date: Nov. 2, 2000

§ 102(e) Date: Nov. 2, 2000

(87) PCT Pub. No.: WO98/32962

PCT Pub. Date: Jul. 30, 1998

(30) Foreign Application Priority Data

Jan. 29, 1997 (JP) ..... 9-015399

(51) Int. Cl.[7] ..... F02D 13/04; F02M 25/07

(52) U.S. Cl. ..... 123/321; 123/568.14

(58) Field of Search ..... 123/568.14, 321

(56) References Cited

U.S. PATENT DOCUMENTS 6,257,213 * 7/2001 Maeda ..... 123/568.14

* cited by examiner

*Primary Examiner*—Henry C. Yuen
*Assistant Examiner*—Arnold Castro
(74) *Attorney, Agent, or Firm*—David R. Yohannan; Collier Shannon Scott, PLLC

(57) ABSTRACT

This invention is an exhaust gas recirculation apparatus such that exhaust gas recirculation master piston (12) is activated and acts to open exhaust valve (4) on the same cylinder (1) by driving a slave piston (14), thus recirculating exhaust gas into combustion chamber (2) from exhaust port (5) as a result of the pressure difference, thereby lowering the combustion temperature within combustion chamber (2) on the next power stroke and working to reduce $NO_x$. Moreover, by selectively maintaining and releasing oil pressure in two types of passages (13) and (31), it can also be used as a compression pressure-release engine brake.

10 Claims, 7 Drawing Sheets

EXHAUST GAS RECIRCULATION DEVICE

FIELD OF THE INVENTION

This invention relates to exhaust gas recirculation apparatuses (EGR devices) that recirculate a portion of the exhaust gas together with aspirated air and send it into the combustion chamber in such a way as to lower the combustion temperature within said combustion chamber, thereby working to reduce $NO_x$ (nitrogen oxides).

BACKGROUND OF THE INVENTION

Conventional exhaust gas recirculation apparatuses are made in such a way that they connect the exhaust pipe and intake port by external piping and open a normally closed EGR valve provided in the path of said external piping using vacuum pressure within the intake port during the intake stroke, thereby causing exhaust gas to recirculate through the above-noted external piping.

However, it turns out that always taking exhaust gas into the combustion chamber on the intake stroke causes lean combustion in conventional exhaust gas recirculation apparatuses as described above, and even though a satisfactory combustion situation can be obtained without difficulty in the light-load operating range in which there is naturally an excess of air, there are problems in that, in the high-load operating range in which the proportion of air with respect to fuel is low, combustion conditions are not good and black smoke with large amounts of soot is readily generated.

Further, because it becomes necessary that the external piping be provided with an EGR valve, the installation space required for the engine increases in volume, and moreover, there is a problem in that careful consideration must be given to providing heat-insulating measures for the external piping which will reach high temperatures as a result of the flow of exhaust gas and to constraints in terms of layout.

In addition, there are also problems in engines equipped with turbochargers, etc., in that exhaust gas cannot be recirculated satisfactorily in operating ranges in which the boost pressure (supercharging pressure within the intake pipe) is higher than the exhaust pressure.

This invention takes these actual circumstances described above in consideration and makes its objective to provide an exhaust gas recirculation apparatus that can recirculate exhaust gas into the combustion chamber only in required operating ranges, and moreover, can recirculate exhaust gas into the combustion chamber without using external piping, and further, in engines equipped with turbochargers, etc., can recirculate exhaust gas acceptably even in operating ranges in which the boost pressure is higher than the exhaust pressure.

SUMMARY OF THE INVENTION

This invention is related to exhaust gas recirculation apparatuses characterized in that they are provided with an exhaust gas recirculation master piston activated by an intake rocker arm that acts to open an intake valve on a cylinder on the intake stroke; a slave piston connected via a first oil passage to said exhaust gas recirculation master piston, and further, that acts to open the aforementioned intake valve and an exhaust valve provided on the same cylinder when pressure is generated in said first oil passage by the action of the aforementioned exhaust gas recirculation master piston; a hydraulic oil supply means that switches between maintaining and releasing oil pressure in the aforementioned first oil passage; a compression pressure-release engine brake master piston activated by an exhaust rocker arm that acts to open an exhaust valve on the cylinder on the exhaust stroke; a slave piston connected via a second oil passage to said compression pressure-release engine brake master piston, and further, when pressure has been generated in said second oil passage by the action of the aforementioned compression pressure-release engine brake master piston, that acts to open an exhaust valve provided separately from the aforementioned exhaust valve on a cylinder approaching compression top dead center; and, a hydraulic oil supply means that switches between maintaining and releasing oil pressure in the aforementioned second oil passage.

Thus, when oil pressure in the first oil passage is maintained by means of the hydraulic oil supply means, the exhaust gas recirculating master piston is activated by the exhaust rocker arm on the intake stroke, pressure is generated in the first oil passage, the exhaust valve on the same cylinder is made to open by the slave piston being driven, and exhaust gas recirculates from the exhaust port into the combustion chamber as a result of the pressure difference, thereby lowering the combustion temperature within the combustion chamber on the next power stroke and working to reduce $NO_x$.

In addition, when oil pressure in the first oil passage is released by means of the hydraulic oil supply means, no oil pressure is generated within the first oil passage, the slave piston is not driven, and the exhaust valve opens only on the exhaust stroke as a result of normal valve action and does not open on the intake stroke.

Further, by selectively maintaining and releasing oil pressure in the first oil passage and the second oil passage, it becomes possible to switch between exhaust gas recirculation mode and compression pressure-release engine braking mode. For example, during braking operation, whenever oil pressure is released in the first oil passage, and further, oil pressure is maintained in the second oil passage, as each respective cylinder approaches compression top dead center with different timings, the compression pressure-release engine brake master piston is activated by the exhaust rocker arm in order to open the exhaust valve of a separate cylinder which is on the exhaust stroke. Pressure is generated in the second oil passage, the slave piston is driven and the exhaust valve of the cylinder is made to open near compression top dead center, compressed air from within the combustion chamber is allowed to pass into the exhaust port, power to push down the piston on the following expansion stroke is no longer generated, and it becomes possible to use it effectively without losing the braking force gained on the compression stroke.

It should also be noted that it is possible to combine the salve piston operated by oil pressure from the first oil passage and the salve piston operated by oil pressure from the second oil passage, and in addition, it is also acceptable that they be provided separately.

In addition, this invention is also related to exhaust gas recirculation apparatuses characterized in that they are provided with an exhaust gas recirculation master piston activated by an exhaust rocker arm that acts to open an exhaust valve on a cylinder on the exhaust stroke; a slave piston connected via a first oil passage to said exhaust gas recirculation master piston, and further, that acts to open the aforementioned exhaust valve and an intake valve provided on the same cylinder when pressure is generated in said first oil passage by the action of the aforementioned exhaust gas recirculation master piston; a hydraulic oil supply means that switches between maintaining and releasing oil pressure in the aforementioned first oil passage; a compression pressure-release engine brake master piston activated by an exhaust rocker arm that acts to open an exhaust valve on a cylinder on the exhaust stroke; a slave piston connected via a second oil passage to said compression pressure-release engine brake master piston, and further, when pressure has been generated in said second oil passage by the activation of the aforementioned compression pressure-release engine brake master piston, that acts to open an exhaust valve provided separately from the aforementioned exhaust valve on a cylinder approaching compression top dead center; and, a hydraulic oil supply means that switches between maintaining and releasing oil pressure in the aforementioned second oil passage.

Thus, when oil pressure is maintained in the first oil passage by means of the hydraulic oil supply means, the exhaust gas recirculating master piston is activated by the exhaust rocker arm on the exhaust stroke, pressure is generated in the first oil passage, the intake valve on the same cylinder is made to open by the slave cylinder being driven, a portion of the exhaust gas within the combustion chamber is swept out to the intake port side, and said exhaust gas swept out to the intake port side is sucked back into the combustion chamber on the next intake stroke and recirculated, and thereby lowering the combustion temperature within the combustion chamber on the following power stroke and working toward a reduction in $NO_x$.

In addition, when oil pressure is released in the first oil passage by means of the hydraulic oil supply means, no oil pressure is generated within the first oil passage, and thus the slave piston is not driven, and the intake valve opens only on the intake stroke as a result of normal valve action and does not open on the exhaust stroke.

Further, by selectively maintaining and releasing oil pressure in the first oil passage and the second oil passage, it becomes possible to switch between exhaust gas recirculation mode and compression pressure-release engine braking mode, and for example, during braking operation, whenever oil pressure is released in the first oil passage, and further, oil pressure is maintained in the second oil passage, as each respective cylinder approaches compression top dead center with different timings, the compression pressure-release engine brake master piston is activated by the exhaust rocker arm in order to open the exhaust valve of a separate cylinder which is on the exhaust stroke. Pressure is generated in the second oil passage, the slave piston is driven and the exhaust valve of the cylinder is made to open near compression top dead center, compressed air from within the combustion chamber is allowed to pass into the exhaust port, power to push down the piston on the following expansion stroke is no longer generated, and it becomes possible to effectively make use of the braking force gained on the compression stroke.

It should also be noted that it is possible to combine the exhaust gas recirculation master piston and the compression pressure-release engine brake master piston, and in addition, it is also acceptable that they be provided separately.

DETAILED DESCRIPTION OF THE PREFERRED EMBODIMENTS

An explanation of the embodiments of the invention follows below with reference made to the drawings.

Figure 1:
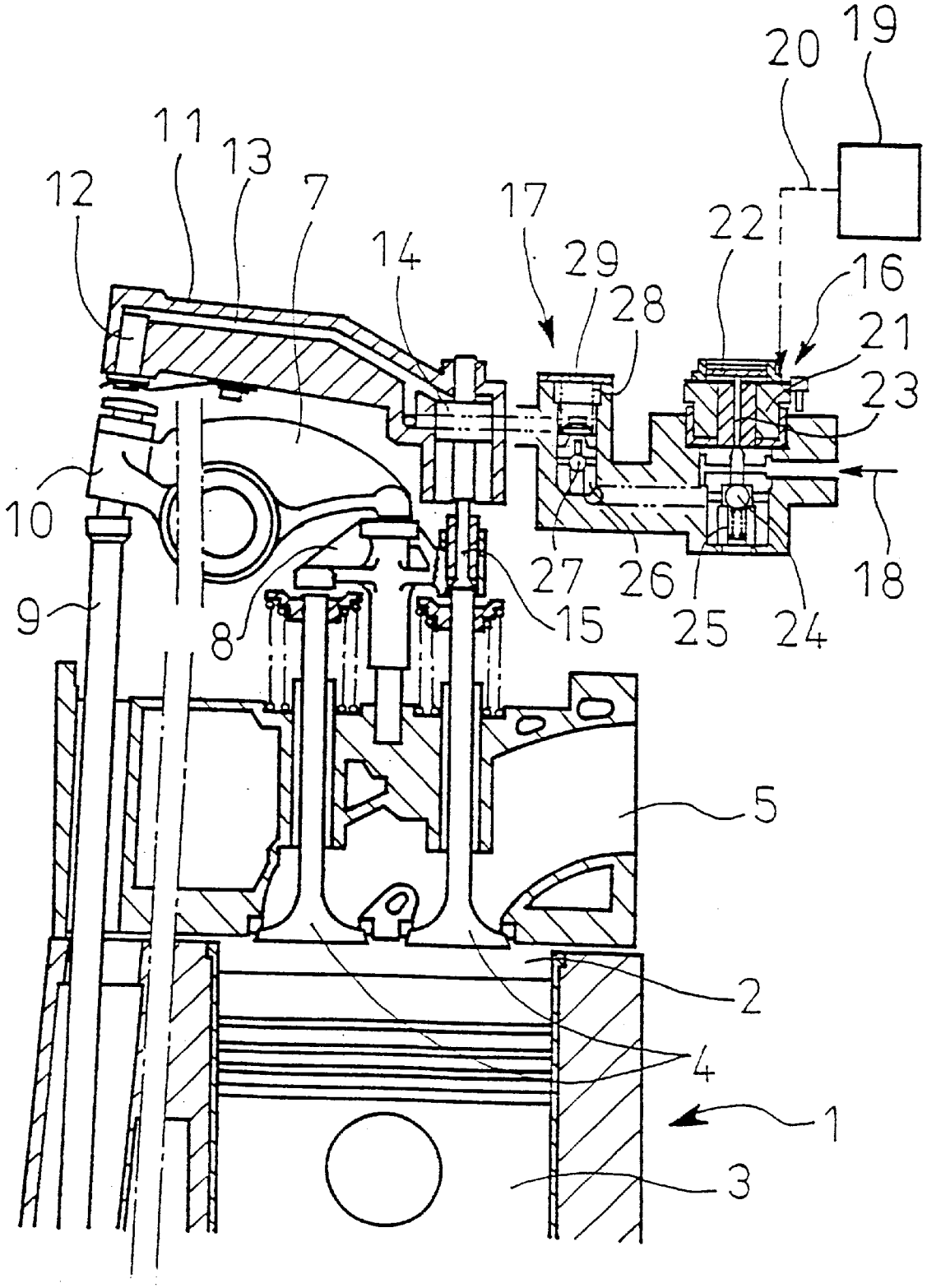
FIG. 1 is a cross-sectional drawing showing a first embodiment of this invention.
Figure 2:
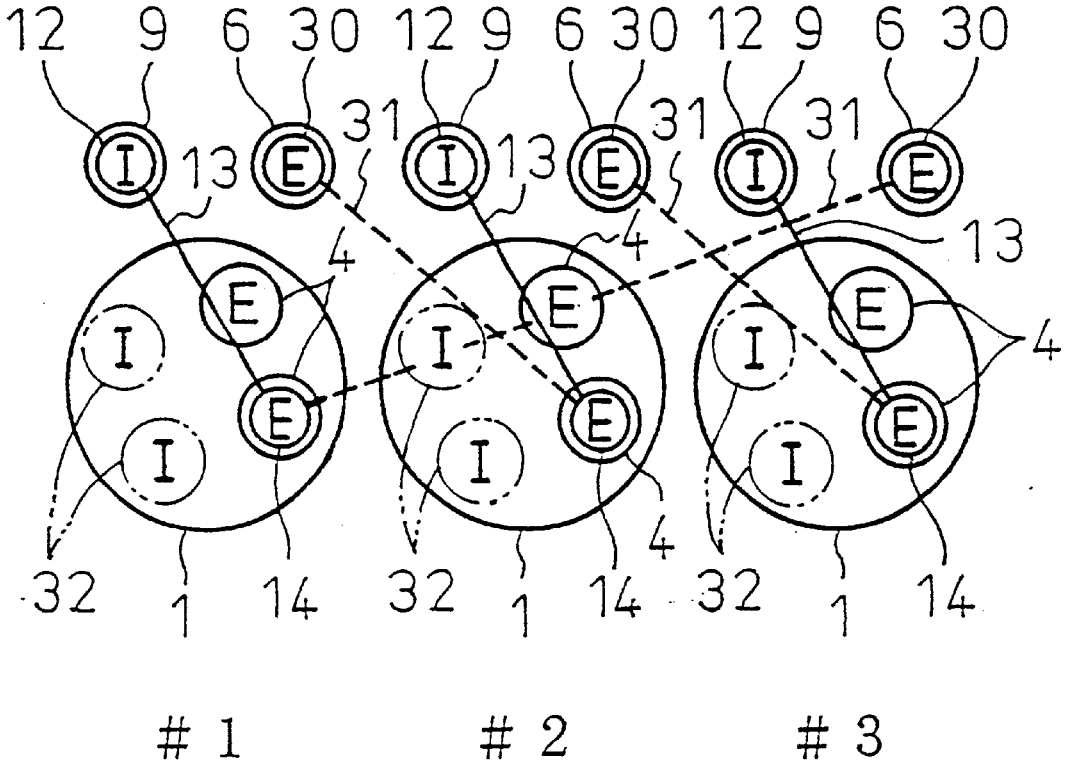
FIG. 2 is an explanatory diagram showing the placement arrangement for a plural number of cylinders.
Figure 3:
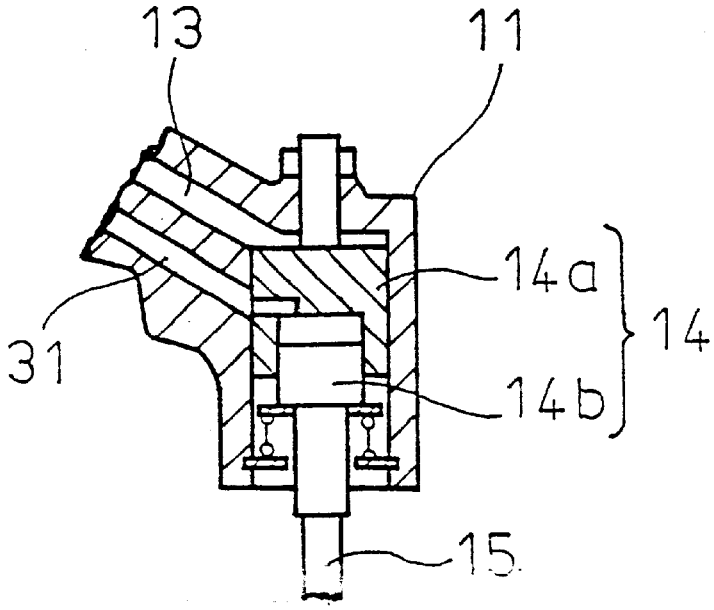
FIG. 3 is a detailed drawing of an example of a slave piston used in the first embodiment.

FIG. 1 to FIG. 3 show a first embodiment of this invention. FIG. 1 shows, respectively, 1, a cylinder; 2, a combustion chamber; 3, a piston; 4, exhaust valves; and 5, an exhaust port. Both exhaust valves 4 are pushed down and opened via bridge 8 by one end of exhaust rocker arm 7 which tilts by being pushed on the other end by exhaust push rod 6 (see FIG. 2) on the exhaust stroke, causing exhaust gas to be scavenged from combustion chamber 2 into exhaust port 5.

In addition, 9 is an inlet push rod on the same cylinder 1 shown, and 10 is an intake rocker arm that tilts by being pushed up on one end by inlet push rod 9. When both intake valves 32 (see FIG. 2) are pushed down and opened via a bridge (not shown in the diagram) similar to that described above by the other end of said intake rocker arm 10, one end of the aforementioned intake rocker arm 10 pushes up on exhaust gas recirculation master piston 12 provided on the top of housing 11, pressure is generated in first oil path 13 bored in the aforementioned housing 11, pushing slave piston 14 down, and one exhaust valve 4 is pushed down independently via actuator pin 15 by means of said slave piston 14.

Hydraulic oil 18 (engine oil) is supplied to first oil path 13, which connects the aforementioned exhaust gas recirculation master piston 12 and slave piston 14, via solenoid valve 16 and control valve 17 which are the hydraulic oil supply means for the purpose of switching between maintaining and releasing oil pressure in said first oil path 13. Solenoid valve 16 carries out the supply and cut-off of hydraulic oil 18 by means of control signal 20 from control apparatus 19, and control valve 17 functions as a check valve so that oil pressure in the aforementioned first oil path 13 will be maintained under conditions in which solenoid valve 16 is open, and further, functions in such a way to release oil pressure in the aforementioned first oil path 13 under conditions in which solenoid valve 16 is closed.

That is to say, using solenoid valve 16, the supply of hydraulic oil 18 is carried out by plate 22 and iron core 23 pushing ball 24 down when coil 21 is excited, and supply of hydraulic oil 18 is cut off by ball 24 being pushed up by spring 25 when coil 21 is in a nonexcited state. In addition, using control valve 17, spool 26 is pushed up by oil pressure under conditions when solenoid valve 16 is open, and further, hydraulic fluid 18 is allowed to flow only in the direction toward the aforementioned first oil path 13 by ball 27 provided in spool 26, and spool 26 is pushed down by spring 28 under conditions when solenoid valve 16 is open and oil pressure is released into relief port 29.

FIG. 2 shows the placement arrangement for this embodiment illustrated in the case of an in-line, six-cylinder engine. It shows only first cylinder #1 (1), second cylinder #2 (1) and third cylinder #3 (1). In any of these first through third cylinders, the action of opening one of the exhaust valves 4 provided on each cylinder 1 during the intake stroke is undertaken by inlet push rod 9 of the same cylinder 1. More concretely, one exhaust valve 4 is opened on the intake stroke by slave piston 14 being driven on the same cylinder 1 via the first oil passage through the action of exhaust gas recirculation master piston 12 via intake rocker arm 10 (not illustrated in FIG. 2) using inlet push rod 9 on each cylinder 1.

In addition, within common housing 11 (not illustrated in FIG. 2), a compression pressure-release engine brake master piston 30 is provided which is activated via exhaust rocker arm 7 (not illustrated in FIG. 2) by exhaust push rod 6 on each cylinder 1, and is connected by a new second oil passage 31 between compression pressure-release engine brake master piston 30 and reciprocal slave piston 14 on cylinder 1 whose stroke timing is set in such a way that slave piston 14 on cylinder 1 approaching compression top dead center is driven by the action of a compression pressure-release engine brake master piston 30 on a separate cylinder 1 which is on the exhaust stroke. Each said second oil passage 31 is made in such a way that it can supply hydraulic oil (engine oil) using a separate network by establishing separately something similar to solenoid valve 16 and control valve 17 described above as a hydraulic oil supply means to switch between maintaining and releasing of oil pressure in second oil passage 31.

It should also be noted that, in the example illustrated, the action of opening exhaust valve 4 in the vicinity of compression top dead center of cylinder #1 (1) is undertaken by exhaust push rod 6 of cylinder #3 (1), and the action of opening exhaust valve 4 in the vicinity of compression top dead center of cylinder #2 (1) is undertaken by exhaust push rod 6 of cylinder #1 (1), and the action of opening exhaust valve 4 in the vicinity of compression top dead center of cylinder #3 (1) is undertaken by exhaust push rod 6 of cylinder #2 (1).

In addition, in this embodiment, the slave pistons 14 of each respective cylinder 1 are driven with different timings by oil pressure from first oil passage 13 and second oil passage 31, and thus, for example, as shown in FIG. 3, slave piston 14 is made a dual structure consisting of primary piston 14*a* and secondary piston 14*b*. When exhaust valve 4 is made to open during the intake stroke, introducing hydraulic fluid 18 from the first oil passage 13 to the top side of primary piston 14*a* causes primary piston 14*a* and secondary piston 14*b* to act in unison, and when exhaust valve 4 is made to open in the vicinity of compression top dead center, introducing hydraulic fluid 18 from second oil passage 31 between primary piston 14*a* and secondary piston 14*b* causes only secondary piston 14*b* to be activated.

Figure 4:
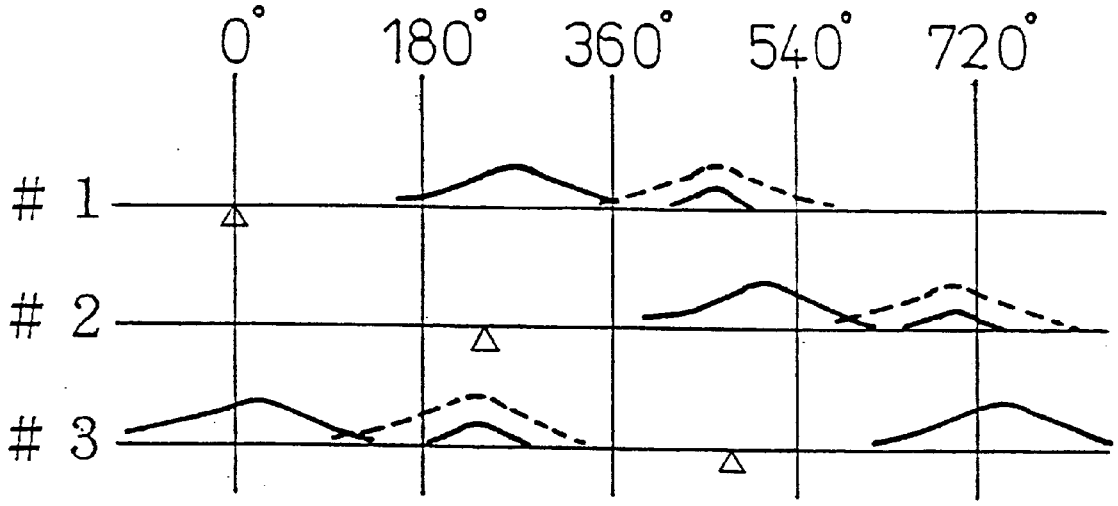
FIG. 4 is a graph showing the operational timing of the exhaust valves in exhaust gas recirculation mode in each cylinder of FIG. 2.

However, because control valve 17 functions as a check valve and first oil passage 13 closes whenever solenoid valve 16 is opened by a control signal 20 from control apparatus 19, when each respective cylinder #1 (1), cylinder #2 (1) and cylinder #3 (1) in FIG. 2 are on the intake stroke with different timings as shown in FIG. 4, intake rocker arm 10 tilts by means of the upthrusting of inlet push rod 9 to open intake valve 32, and as a result, exhaust gas recirculation master piston 12 is pushed up and pressure is generated in first oil passage 13 causing slave piston 14 on the same cylinder 1 to be driven, thereby causing one exhaust valve 4 to open and recirculating exhaust gas from exhaust port 5 into combustion chamber 2 by the pressure difference. Thus, the combustion temperature within combustion chamber 2 is lowered on the next power stroke, thereby working to reduce $NO_x$ (nitrogen oxides).

It should also be noted that, in FIG. 4, the vertical axis is regarded as the valve operation lift and the horizontal axis is regarded as the rotation angle of the cam shaft of cylinder #1. The Δ in the diagram indicate the compression top dead center at each cylinder 1, the solenoid curved lines indicate the lift of exhaust valve 4 at each cylinder 1, and the broken curved lines represent the lift of intake valve 32, respectively (for example, the rotation angles from 0° to 180° is the power stroke, from 180° to 360° is the exhaust stroke, from 360° to 540° is the intake stroke, and from 540° to 720° is the compression stroke; the phase of cylinder #2 and cylinder #3 is shifted starting from the compression top dead center).

In addition, because no pressure is generated within first oil passage 13 whenever solenoid valve 16 is closed by a control signal 20 from control unit 19, oil pressure in first oil passage 13 is released by control valve 17, slave piston is not driven and exhaust valve 4 opens only on the exhaust stroke by normal valve action and does not open on the intake stroke.

Consequently, because the exhaust gas can be recirculated to combustion chamber 2 only in the required operating regions, the above-mentioned embodiment can lower combustion temperature by recirculating exhaust gas to combustion chamber 2 in light-load operating regions, thus working to reduce $NO_x$, while in high-load operating regions, it can cut off recirculation of exhaust gas and prevent the generation of black smoke with large amounts of soot by normal valve action.

Moreover, because it is possible to eliminate the end for external piping, it is possible to avoid increases in volume of the engine installation space as well as eliminate the need to give careful consideration to heat-insulation measures for the external piping and to layout constraints. In addition, it becomes possible to recirculate exhaust gas satisfactorily even in operating ranges in which the boost pressure in engines equipped with turbochargers is higher than the exhaust pressure.

It should also be noted that, in doing control in such a way that exhaust gas is recirculated into combustion chamber 2 in light-load operating ranges and recirculation of exhaust gas is halted in high-load operating ranges, for the aforementioned control apparatus 19, solenoid valve 16 may be opened by control signal 20 from the aforementioned control apparatus 19 under conditions in which a signal indicating the engine operating status, a signal indicating the accelerator activation status, etc., and a signal for the exhaust gas recirculation switch of the operating chamber, etc., is input, and the engine is under powered operation in which the exhaust gas recirculation switch of the operating chamber is ON and the accelerator has been depressed to some extent, and further, no high load is present.

Figure 5:
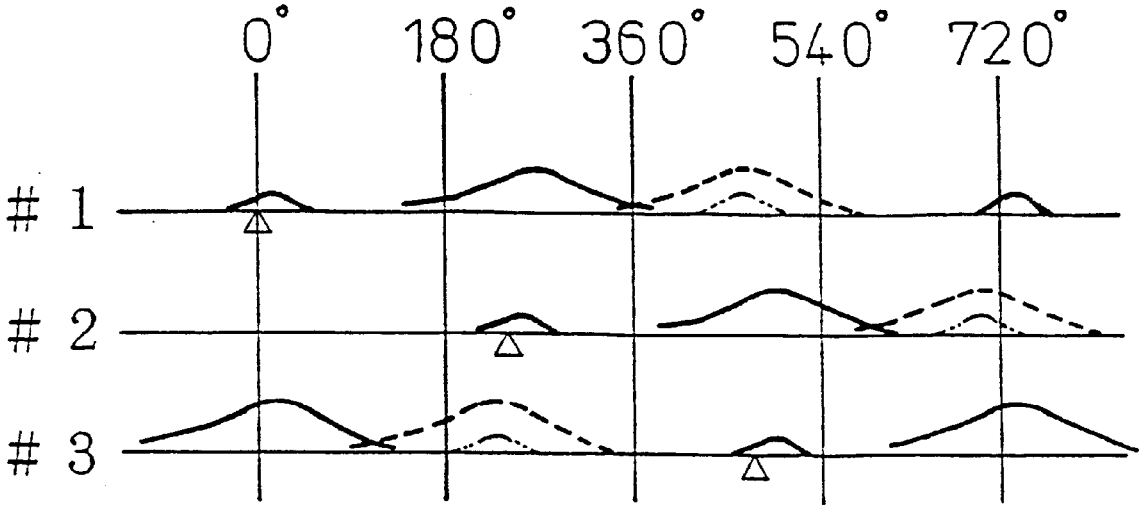
FIG. 5 is a graph showing the operational timing of the exhaust valves in compression pressure-release engine braking mode in each cylinder of FIG. 2.

In addition, the fact that first oil passage 13 for exhaust gas recirculation and second oil passage 31 for compression pressure release engine braking close selectively makes it possible to switch between exhaust gas recirculation mode and engine braking mode. For example, during braking operations, whenever oil pressure in first oil passage 13 for exhaust gas recirculation is released, and further, oil pressure is maintained by closing second oil passage 31 for compression pressure release engine braking, when each respective cylinder #1 (1), cylinder #2 (1), and cylinder #3 (1) in FIG. 2 approach compression top dead center with different timings as illustrated in FIG. 5, compression pressure release engine braking master piston 30 is pushed up by exhaust rocker arm 7 as a result of the upthrusting of exhaust push rod 6 in order to open the exhaust valve 4 of a separate cylinder 1 which is on the exhaust stroke, thereby generating pressure in second oil passage 31. And because slave piston 14 on cylinder 1 which is approaching compression top dead center is driven, it causes one of the exhaust valves 4 to open, compressed air from combustion chamber 2 is allowed to escape into exhaust port 5, and no force to push down piston 3 is generated on the next expansion stroke. Thus it becomes possible to use the exhaust gas recirculation apparatus of this invention to make effective use of the braking force obtained on the compression stroke.

It should also be noted that the two-dot dashed-line curves in FIG. 5 represent the lift of exhaust valve 4 during the intake stroke of each cylinder 1 when in exhaust gas recirculation mode, and its operational timing is identical to that of the case in the above-mentioned FIG. 4.

Figure 6:
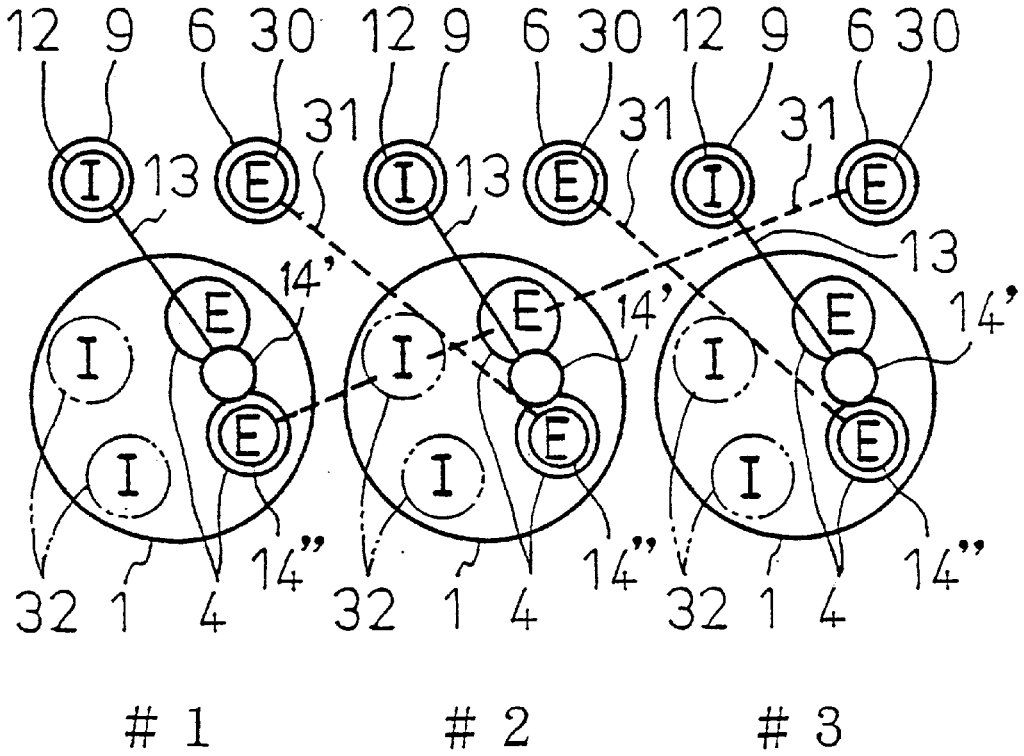
FIG. 6 is an explanatory drawing showing a second embodiment of this invention.
Figure 7:
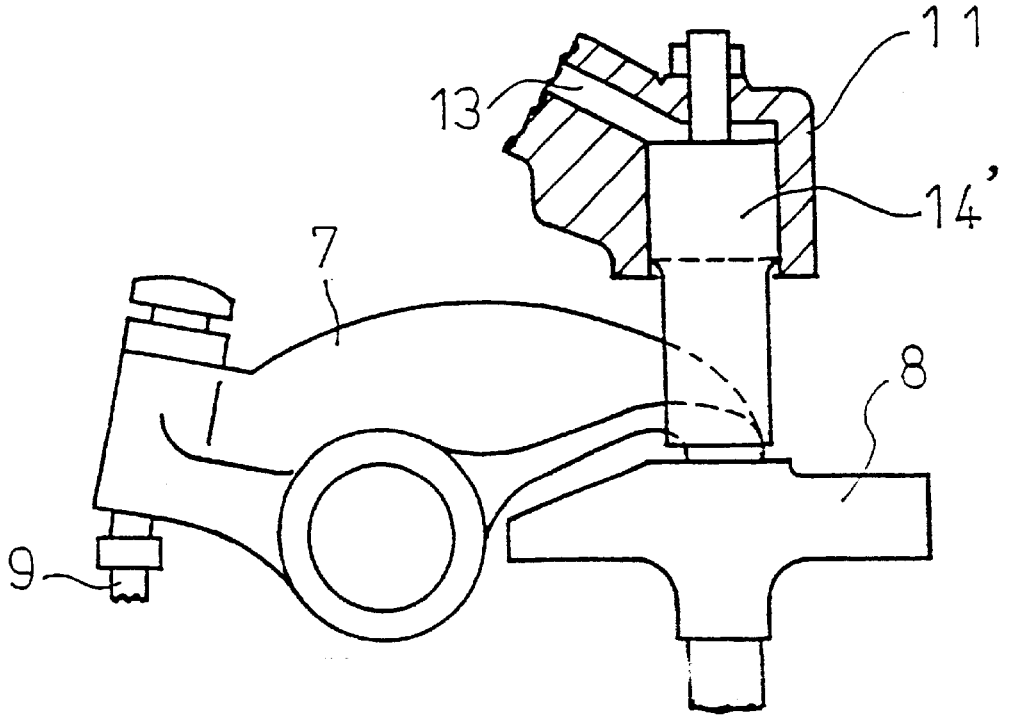
FIG. 7 is a detailed drawing of an example of one side of a slave piston used in the second embodiment.

FIG. 6 and FIG. 7 show a second embodiment of this intention, and this embodiment differs only on the point that, respectively, a first slave piston 14' that opens together with both exhaust valves 4 of each cylinder 1 on the intake stroke in exhaust gas recirculation mode, and a second slave piston 14" that opens with one exhaust valve 4 of each cylinder 1 as it approaches compression top dead center in compression pressure release engine braking mode are provided separately.

That is to say, this embodiment is such that it is possible on the intake stroke to open both exhaust valves together on each respective cylinder 1 by means of the first slave piston 14', and the first slave piston 14' in this embodiment is such that, on the intake stroke, it pushes down on bridge 8 which is pushed down by exhaust rocker arm 7 of each cylinder 1 on the exhaust stroke as normal valve operation, and is arranged astride the aforementioned exhaust rocker arm 7 and does not impede normal valve action during the exhaust stroke (see FIG. 7).

In contrast, it is advisable that the second slave piston 14" have a mechanism similar to slave piston 14 shown in FIG. 1.

In this way, the recirculation efficiency of exhaust gas can be increased by opening both exhaust gas valves 4 together on the exhaust stroke in exhaust gas recirculation mode, and further, because the pressure within combustion chamber 2 is lowered on the exhaust stroke, the action of opening both exhaust valves 4 can be implemented without significant difficulty.

However, it is also possible to arrange it by reversing the connection between first oil passage 13 and second oil passage 31 so as to cause the first slave piston 14' to activate in compression pressure release engine braking mode, and further, cause the second slave piston 14" to activate in exhaust gas recirculation mode.

Figure 8:
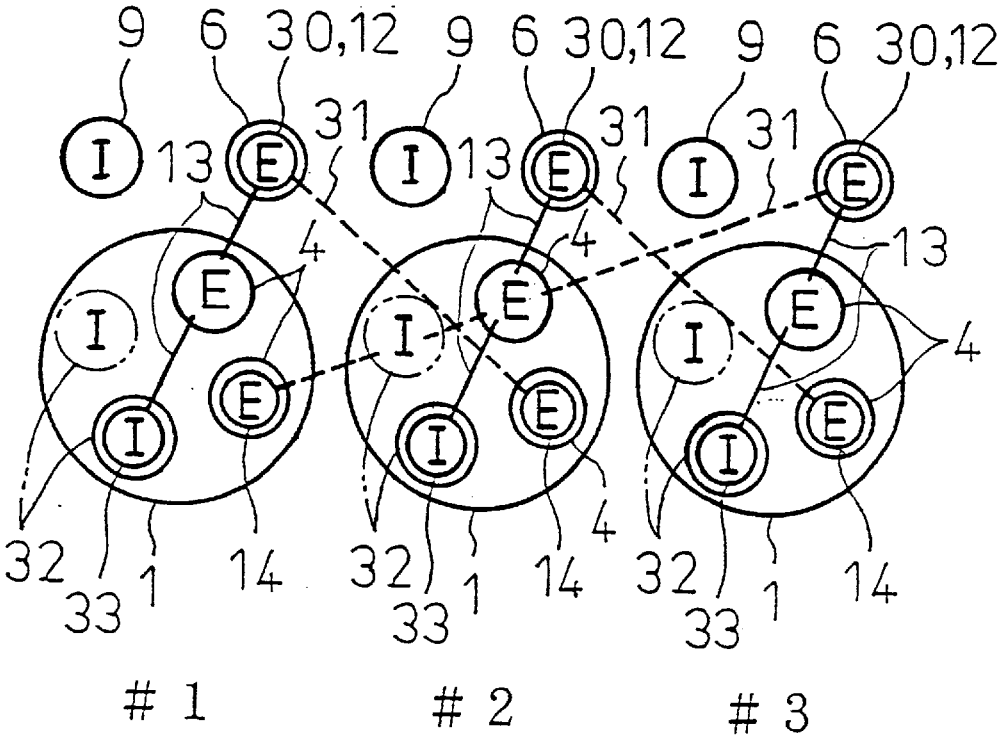
FIG. 8 is an explanatory drawing showing a third embodiment of this invention.
Figure 9:
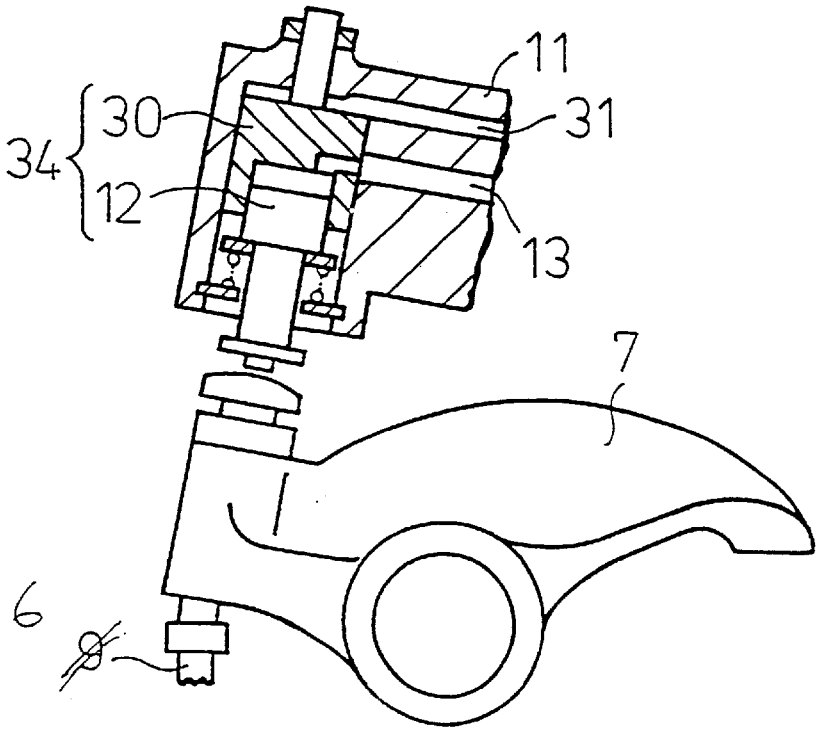
FIG. 9 is a detailed drawing showing an example of a dual-use master piston using in the third embodiment.
Figure 10:
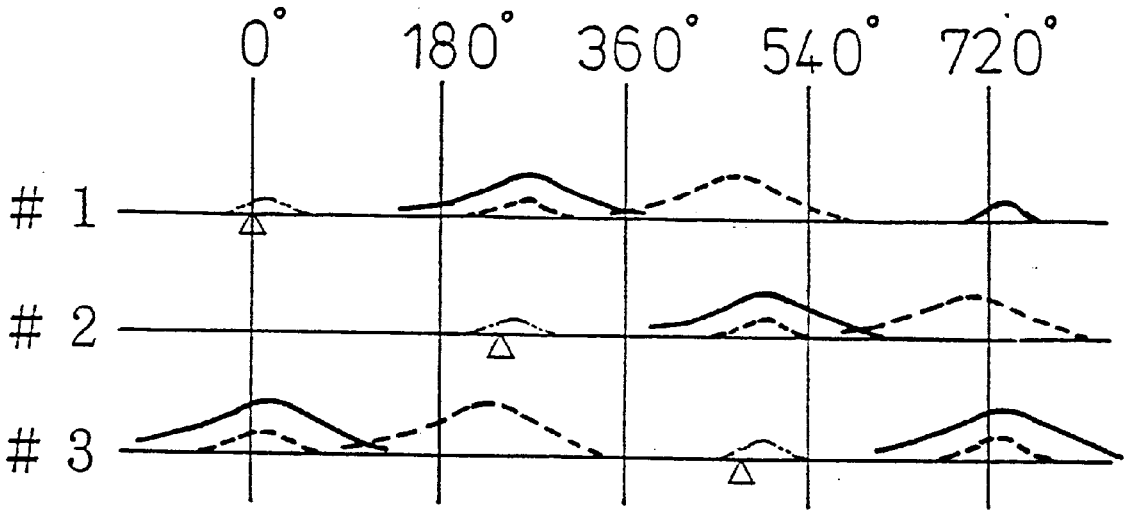
FIG. 10 is a graph showing the operational timing of the intake valve in exhaust gas recirculation mode in each cylinder of FIG. 8.

FIG. 8 through FIG. 10 show a third embodiment of this invention, and it is such that one can selectively switch between exhaust gas recirculation mode and compression pressure release engine braking mode in a manner similar to the case in the previous embodiment. However, this embodiment causes exhaust gas recirculation master piston 12 to be activated by exhaust rocker arm 7 which opens exhaust valve 4 on cylinder 1 on the exhaust stroke, and moreover, is such it is possible to open one intake valve 32 on the same cylinder 1 on the exhaust stroke by the activation of this exhaust gas recirculation master piston 12.

That is to say, as illustrated by only cylinder #1 (1), cylinder #2 (1), and cylinder #3 (1) in the case of the in-line six-cylinder engine in FIG. 8, on each of the first through third cylinders 1, the action of opening one intake valve 32 provided on each cylinder 1 on the exhaust stroke is undertaken by exhaust push rod 6 on the same cylinder 1. More concretely, one exhaust valve 4 can be opened on the intake stroke by driving the salve piston 33 on the same cylinder via first oil passage 13 by means of the action of exhaust gas recirculation master piston 12 via exhaust rocker arm 7 (not shown in FIG. 8) through exhaust push rod 6 on each cylinder 1.

This embodiment is such that exhaust gas recirculation master piston 12 and compression pressure release engine braking master piston 30 can be combined. More concretely, as shown in FIG. 9, it adopts a double-structure dual-use master piston 34 constructed with compression pressure release engine braking master piston 30 as the primary piston, and further, exhaust gas recirculation master piston 12 inside compression pressure release engine braking master piston 30 as the secondary piston.

Thus, when intake valve 32 opens on the intake stroke, oil pressure in the second oil passage 31 that connects to the top side of compression pressure release engine braking master piston 30, the primary piston, is released, and further, oil pressure is maintained by closing the first oil passage 13 that connects to the top side of exhaust gas recirculation master piston 12, the secondary piston, thus activating only exhaust gas recirculation master piston 12, the secondary piston. When exhaust valve 4 opens in the vicinity of compression top dead center, the entire dual-use master piston 34 is activated as a single unit, closing the second oil passage 31 and releasing the first oil passage 13.

In addition, it is advisable for slave piston 33 which opens one intake valve 32 on the exhaust stroke to have a structure similar to slave piston 14 shown in FIG. 1.

Thus, in this way, when each respective cylinder #1 (1), cylinder #2 (1), and cylinder #3 (1) in FIG. 8 reaches the exhaust stroke with different timings as shown in FIG. 10, exhaust rocker arm 7 tilts with the upthrusting of exhaust push rod 6 in order to open exhaust valve 4, and as a result, pressure is generated in the first oil passage 13 by exhaust gas recirculation master piston 12 being pushed up, intake valve 32 opens by slave piston 33 on the same cylinder being driven, a portion of the exhaust gas within combustion cylinder 2 is swept out to the intake port side (not shown), and thus the exhaust gas swept out into said exhaust port side is sucked back into combustion chamber 2 on the next intake stroke and recirculated, lowering the combustion temperature within combustion chamber 2 on the next power stroke, and thereby working to reduce $NO_x$ (nitrogen oxides).

It should also be noted that, in FIG. 10, similar to the previous FIG. 4 and FIG. 5, the vertical axis is the valve operation lift and the horizontal axis is the rotational angle of the camshaft of cylinder #1. The Δ in the diagram represent the compression top dead center on each cylinder 1, the solid curved lines represent the lift of exhaust valve 4 and the broken curved lines represent the lift of intake valve 32, respectively, at each cylinder 1, but the double-dot dashed-line curves in the diagram indicate the lift of exhaust valve 4 in the vicinity of compression top dead center on each cylinder 1 for the case of compression pressure release engine braking mode. The operational timings are identical to the case of FIG. 5 described previously.

Consequently, in the case of this embodiment, too, because exhaust gas can be recirculated into combustion chamber 2 only in the required operating ranges, combustion temperature is lowered by recirculating exhaust gas into combustion chamber 2 in light-load operating ranges, thereby working to reduce $NO_x$, and recirculation of exhaust gas can be halted in the high-load operating range, thereby preventing the generation of black smoke with large amounts of soot by normal valve action, and moreover, because external piping can be eliminated, it is possible to avoid an increase in the volume of the installation space for the engine as well as eliminate the need to give careful consideration to heat-insulation measures for the external piping and to layout limitations. In addition, it becomes possible to recirculate exhaust gas satisfactorily even in operating regions in which the boost pressure in engines equipped with turbochargers, etc., is higher than exhaust pressure.

In addition, by selectively closing both the first oil passage 13 for exhaust gas recirculation and the second oil passage 31 for compression pressure release engine braking, it is possible to switch between exhaust gas recirculation mode and compression pressure release engine braking.

Figure 11:
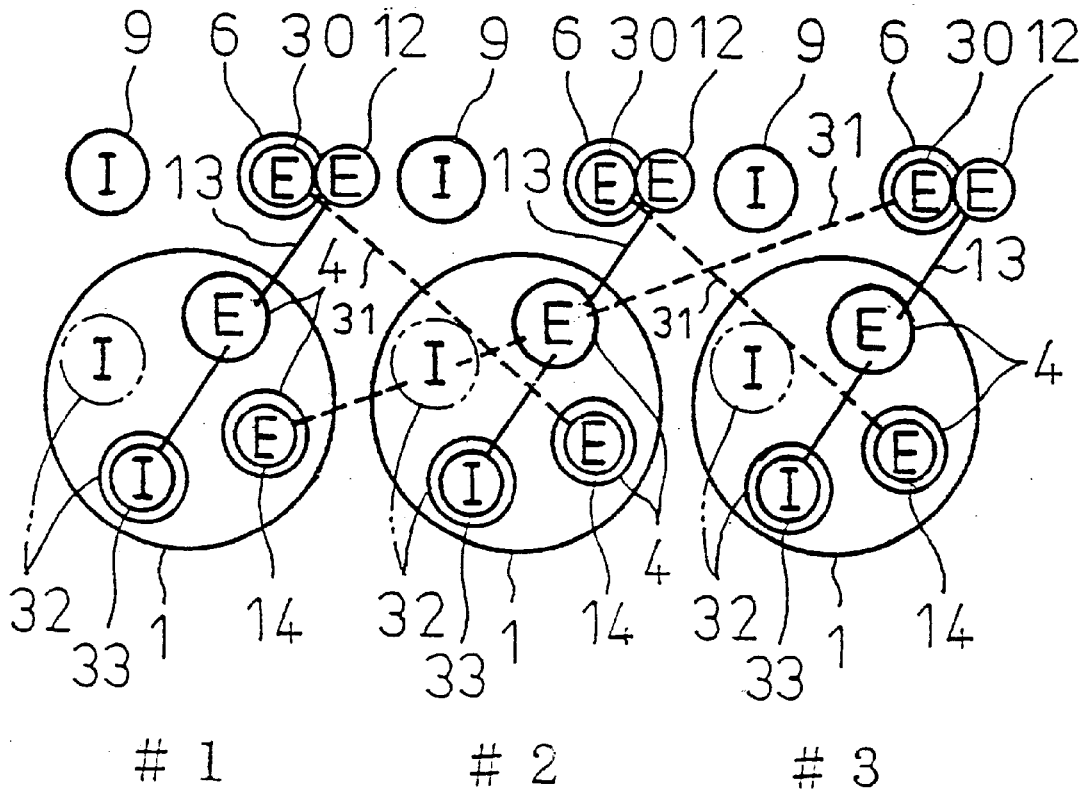
FIG. 11 is an explanatory drawing of a fourth embodiment of this invention.
Figure 12:
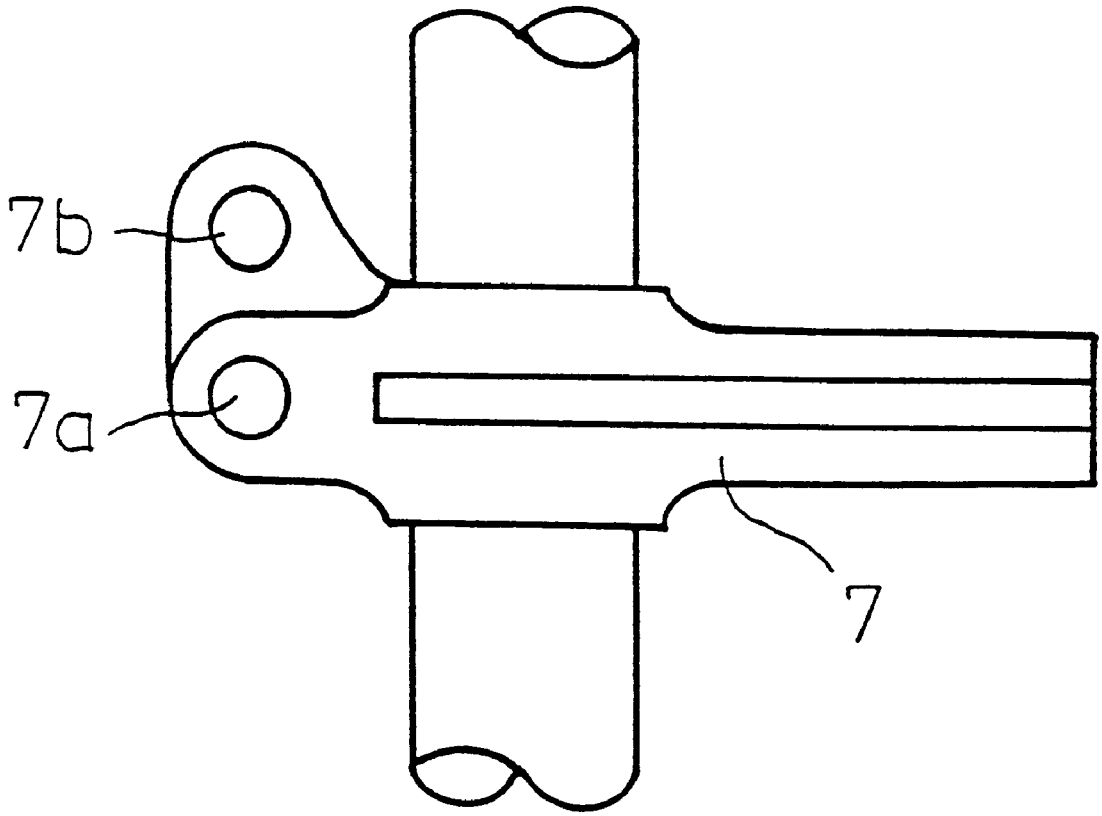
FIG. 12 is a top view showing an example of an exhaust rocker arm used in the fourth embodiment.

FIG. 11 and FIG. 12 show a fourth embodiment of this invention. It differs in comparison with previous embodiments in the point that exhaust gas recirculation master piston 12 and compression pressure release engine braking master piston 30 are provided individually and separately, but its functional effect is identical to previous embodiments.

In the activation of both master pistons 12 and 30 by an exhaust rocker arm 7, for example, as shown in the top view in FIG. 12, it is advisable to mount both contact connector 7*a* that pushes up compression pressure release engine braking master piston 30, and contact connector 7*b* that pushes up exhaust gas recirculating master piston 12, respectively, side-by-side on the end of exhaust rocker arm 7.

It should also be noted that the exhaust gas recirculating apparatus of this invention is not limited to only the embodiments described above and that the various embodiments were explained using the illustrative example of the case of an in-line six-cylinder [engine]. It is also applicable in a similar manner to other engine configurations such as V-engines having a different number of cylinders. In addition, various types of modifications can, of course, be added within the scope of the claims without deviating from the substance of this invention.

Industrial Applicability

The exhaust gas recirculation apparatus of such an invention as above will find utility as an apparatus to purge the exhaust gas of engines in automobiles, etc., and is particularly applicable for use in engines whose installation space is small and for engines equipped with turbochargers, etc.

What is claimed is:

1. An exhaust gas recirculation apparatus characterized in that it is provided with an exhaust gas recirculation master piston activated by an intake rocker arm that acts to open an intake valve on a cylinder on the intake stroke;

a slave piston connected via a first oil passage to said exhaust gas recirculation master piston, and further, that acts to open the aforementioned intake valve and an exhaust valve provided on the same cylinder when pressure is generated in said first oil passage by the action of the aforementioned exhaust gas recirculation master piston;

a hydraulic oil supply means that switches between maintaining and releasing oil pressure in the aforementioned first oil passage;

a compression pressure-release engine brake master piston activated by an exhaust rocker arm that acts to open an exhaust valve on the cylinder on the exhaust stroke;

a slave piston connected via a second oil passage to said compression pressure-release engine brake master piston, and further, when pressure has been generated in said second oil passage by the action of the aforementioned compression pressure-release engine brake master piston, that acts to open an exhaust valve provided separately from the aforementioned exhaust valve on a cylinder approaching compression top dead center; and, a hydraulic oil supply means that switches between maintaining and releasing oil pressure in the aforementioned second oil passage.

2. An exhaust gas recirculation apparatus according to claim 1 characterized in that the slave piston activated by oil pressure from the first oil passage, and the slave piston activated by oil pressure from the second oil passage are combined.

3. An exhaust gas recirculation apparatus according to claim 1 characterized in that the slave piston activated by oil pressure from the first oil passage, and the slave piston activated by oil pressure from the second oil passage are provided separately.

4. An exhaust gas recirculation apparatus according to claim 1 characterized in that it is applicable to straight six cylinder engines.

5. An exhaust gas recirculation apparatus according to claim 2 characterized in that it is applicable to straight six cylinder engines.

6. An exhaust gas recirculation apparatus according to claim 3 characterized in that it is applicable to straight six cylinder engines.

7. An exhaust gas recirculation apparatus characterized in that it is provided with an exhaust gas recirculation master piston activated by an exhaust rocker arm that acts to open an exhaust valve on a cylinder on the exhaust stroke;

a slave piston connected via a first oil passage to said exhaust gas recirculation master piston, and further, that acts to open the aforementioned exhaust valve and an intake valve provided on the same cylinder when pressure is generated in said first oil passage by the action of the aforementioned exhaust gas recirculation master piston;

a hydraulic oil supply means that switches between maintaining and releasing oil pressure in the aforementioned first oil passage;

a compression pressure-release engine brake master piston activated by an exhaust rocker arm that acts to open an exhaust valve on a cylinder on the exhaust stroke;

a slave piston connected via a second oil passage to said compression pressure-release engine brake master piston, and farther, when pressure has been generated in said second oil passage by the activation of the aforementioned compression presure-release engine brake master piston, that acts to open an exhaust valve provided separately from the aforementioned exhaust valve on a cylinder approaching compression top dead center; and, a hydraulic oil supply means that switches between maintaining and releasing oil pressure in the aforementioned second oil passage.

8. An exhaust gas recirculation apparatus according to claim 7 characterized in that the exhaust gas recirculation master piston, and compression pressure-release brake master piston are combined.

9. An exhaust gas recirculation apparatus according to claim 7 characterized in that the exhaust gas recirculation master piston, and compression pressure-release engine brake master piston are provided separately.

10. An exhaust gas recirculation apparatus for a multi-cylinder engine comprising:

at least two rocker arms associated with a first engine cylinder;

an exhaust gas recirculation master piston assembly associated with the first engine cylinder and operatively connected to a rocker arm;

at least two engine valves associated with the first engine cylinder, each engine valve being operatively connected to a separate rocker arm;

a first slave piston assembly associated with the first engine cylinder and connected via a first oil passage to the exhaust gas recirculation master piston assembly, wherein the first slave piston assembly actuates a first one of the at least two engine valves during the time a rocker arm actuates a second one of the at least two engine valves;

means for supplying and releasing oil pressure in the first oil passage;

a compression pressure-release master piston assembly associated with the first engine cylinder and operatively connected to a rocker arm;

a second slave piston assembly associated with a second engine cylinder and connected via a second oil passage to the compression pressure-release master piston assembly, wherein the second slave piston assembly actuates an exhaust valve of the second engine cylinder during the time a rocker arm actuates one of the at least two engine valves of the first engine cylinder; and means for supplying and releasing oil pressure in the second oil passage.

* * * * *